United States Patent [19]

Barth et al.

[11] 4,168,130

[45] Sep. 18, 1979

[54] APPARATUS FOR PLACING PAVING ELEMENTS

[75] Inventors: Günter Barth, Karlsruhe; Fritz von Langsdorff, Rastatt, both of Fed. Rep. of Germany

[73] Assignees: Dr. Barth KG, Karlsruhe; F. von Langsdorff Bauverfahren GmbH, Rastatt, both of Fed. Rep. of Germany

[21] Appl. No.: 897,131

[22] Filed: Apr. 17, 1978

[30] Foreign Application Priority Data

Apr. 22, 1977 [DE] Fed. Rep. of Germany ..... 2718066
Jul. 14, 1977 [DE] Fed. Rep. of Germany ..... 2731942

[51] Int. Cl.[2] ..... E01C 11/28
[52] U.S. Cl. ..... 404/99; 52/749; 414/446
[58] Field of Search ..... 404/99; 214/370, 372; 52/749

[56] References Cited

U.S. PATENT DOCUMENTS

| | | | |
|---|---|---|---|
| 891,972 | 6/1908 | Banwell | 404/99 X |
| 1,023,006 | 4/1912 | Carriker . | |
| 1,339,069 | 5/1920 | Rodgers et al. | 404/99 |
| 2,184,906 | 12/1939 | Buhrmann | 404/99 |
| 3,039,632 | 6/1962 | Wise | 404/99 X |

FOREIGN PATENT DOCUMENTS

| | | | |
|---|---|---|---|
| 2248397 | 4/1974 | Fed. Rep. of Germany . | |
| 2426713 | 12/1975 | Fed. Rep. of Germany . | |
| 57604 | 9/1967 | German Democratic Rep. | 404/99 |
| 6606429 | 11/1967 | Netherlands | 404/99 |
| 1282847 | 7/1972 | United Kingdom . | |
| 1286610 | 8/1972 | United Kingdom . | |
| 1311767 | 3/1973 | United Kingdom . | |
| 1333443 | 10/1973 | United Kingdom . | |
| 1415928 | 12/1975 | United Kingdom . | |
| 193564 | 5/1967 | U.S.S.R. | 404/99 |

*Primary Examiner*—Nile C. Byers, Jr.
*Attorney, Agent, or Firm*—Spencer & Kaye

[57] ABSTRACT

Apparatus for taking paving elements from a store of such elements, moving them over a placing position and placing them successively onto the subsoil. In one preferred form the apparatus comprises a fork-lift truck having a mast, a jib carried by that mast, swivel means permitting the jib to be swivelled about an upright swivelling axis, a trolley adapted to run along the jib, elevator means for raising and lowering the load carrier, and the arrangement being such that the load carrier can take the paving elements from the store irrespective of the swivelling position of the jib. In a second preferred form the arrangement is such that the load carrier having a plurality of suction apertures to engage respective paving elements can take the paving elements as they have passed an aligning device for a simultaneous alignment of a plurality of roughly aligned paving elements.

8 Claims, 4 Drawing Figures

APPARATUS FOR PLACING PAVING ELEMENTS

BACKGROUND OF THE INVENTION

The invention relates to an apparatus for placing paving elements, particularly slabs, stones or blocks, inter-engaging stones or blocks, large paving slabs, and large paving slabs adapted to be broken into smaller pieces in desired rupture zones. With paving elements of this kind the subsoil can be surfaced, for example for roads, paths, courtyards, squares, watercourses, river beds, embankments, and the like.

Hitherto such paving elements have either been placed by hand or handled by placing carts by which the paving elements are taken to the respective placing sites one by one. In contrast thereto the invention provides an apparatus which is constructed in a particularly suitable manner for the placing of paving elements and with which a large area can be covered with paving elements without the apparatus having to be moved from its position.

SUMMARY OF THE INVENTION

The invention provides an apparatus for placing paving elements, the apparatus comprising: a mast; a jib carried by said mast; swivel means permitting said jib to be swivelled about an upright swivelling axis, said axis being disposed above and as seen in plan view proximate a storing space adapted to receive a store of such paving elements; a trolley adapted to run along said jib; a load carrier carried by said trolley; elevator means for raising and lowering said load carrier; the arrangement being such that said load carrier can take paving elements from said store of paving elements from under said jib within a swivelling angle range, irrespective of the swivelling position of said jib, and deposit said paving elements in a placing position.

For the purpose of picking up the paving elements from the store the load carrier and/or the entire jib can be raised and lowered. The load carrier can pick up one individual paving element at a time, or simultaneously pick up a larger number of paving elements lying side by side or else a number of paving elements lying one on the other. In the last-mentioned case only the paving element that is lowermost at the time is laid down at a determined placing site and the load carrier is then moved to another placing site; when all the paving elements in the stack have been placed, the trolley returns to the store and picks up a fresh stack of paving elements lying one on the other. When a group of paving elements lying side by side is to be picked up, this can be done for example by means of a gripper which holds the individual paving elements together by lateral pressure, or else it is possible for example to use a gripper which has suction openings and which holds the individual paving elements by suction. The paving elements are preferably composed of concrete.

As the swivelling axis of the jib is disposed above and, in plan view, near the store, the trolley can be returned to a position which automatically is above the store irrespective of the position to which the jib is swivelled at any moment, at least within a wide swivelling angle range of the jib of for example 180° or 270°. The swivelling axis may but need not be disposed above the center of the store; nevertheless the swivelling axis should be disposed in plan view so close to the store that, irrespective of the position to which the jib is swivelled at the moment in question, within at least the above described wide swivelling angle range of the jib, paving elements can be picked up from the store by at most deflecting the load carrier laterally to a certain extent.

In order to ensure that the trolley will automatically return to the correct position in the longitudinal direction of the jib also, a suitable stop may be provided.

The mast of the apparatus is preferably part of a vehicle, for example the mast of a fork-lift truck. The mast can in that case be moved in a simple manner to a different position when the area which can be covered by the jib with the mast in its previous position has been completely surfaced with paving elements. It is in addition advantageous for the store to be disposed on a support carried by the vehicle, for example the arms of a fork-lift truck. The vehicle itself can then fetch a fresh supply of paving elements from elsewhere, for example from a delivery lorry bringing the paving elements, when the previous stock of paving elements has been placed.

As a further development of the invention the jib may be mounted for tilting about a horizontal axis so that it can be inclined upwards and downwards in a substantially vertical plane. In this way, when the trolley is moving away from the mast the jib can be so inclined that the trolley runs downwards, while for the return movement of the trolley the jib can be inclined in the opposite direction, so that the trolley runs back downwards. It is advantageous to utilise only such small angles of inclination that the running movement of the trolley can be controlled by hand. It is however also possible to utilise for this purpose the bending of the jib under the load of the trolley carrying a paving element.

The apparatus of the invention, in one of its forms, may also be used for simultaneously placing a group of individual paving elements aligned side by side, namely by means of a load carrier which has at least one suction aperture per paving element, if an aligning device is provided in association with the store by which a number of roughly pre-aligned paving elements can be arranged to form an accurately aligned group. If paving elements, particularly paving stones or inter-engaging blocks, are for example delivered to the site in the form of a stack on a pallet, the paving elements in the layers of the stack will already be lying side by side in a roughly pre-aligned form. If it is now desired to lift and place an entire layer of this kind with a load carrier having at least one suction aperture per paving element, it is necessary for more accurate alignment to be effected so that the suction apertures will actually line up with the paving elements and not, for example, with the gaps between the paving elements, so that the paving elements can be placed with the desired accurate mutual alignment.

It is particularly advantageous for the aligning device to comprise an aligning frame at least part of the walls of which converge, and also a displacing device by which the number of roughly pre-aligned paving elements and the aligning frame can be displaced relative to one another. The number of paving elements can thus be automatically aligned in a particularly simple manner by displacing relative to one another the aligning frame and the respective number of roughly pre-aligned paving elements. If the paving elements are delivered as layers of a stack, this aligning is preferably effected one layer at a time. A particularly simple placing apparatus is obtained if the aligning frame is fastened on a fork-lift truck and the arms of the fork-lift truck constitute a store means and are used as displacing device.

The invention further provides an apparatus for placing paving elements, the apparatus comprising: a mast; a jib carried by said mast; swivel means permitting said jib to be swivelled about an upright swivelling axis; a trolley adapted to run along said jib; an aligning device adapted for alignment of a plurality of roughly aligned paving elements; a load carrier carried by said trolley and comprising a plurality of suction apertures adapted and positioned for holding said aligned paving elements; elevator means for raising and lowering said load carrier; the arrangement being such that said load carrier can take said aligned paving elements from under said jib and deposit said aligned paving elements in a placing position. All preferred forms and developments described in the foregoing can be realized also with this further form of the invention.

BRIEF DESCRIPTION OF THE DRAWINGS

Two embodiments of the invention will now be described by way of example with reference to the accompanying drawings in which:-

DESCRIPTION OF THE PREFERRED EMBODIMENTS

Figure 1:
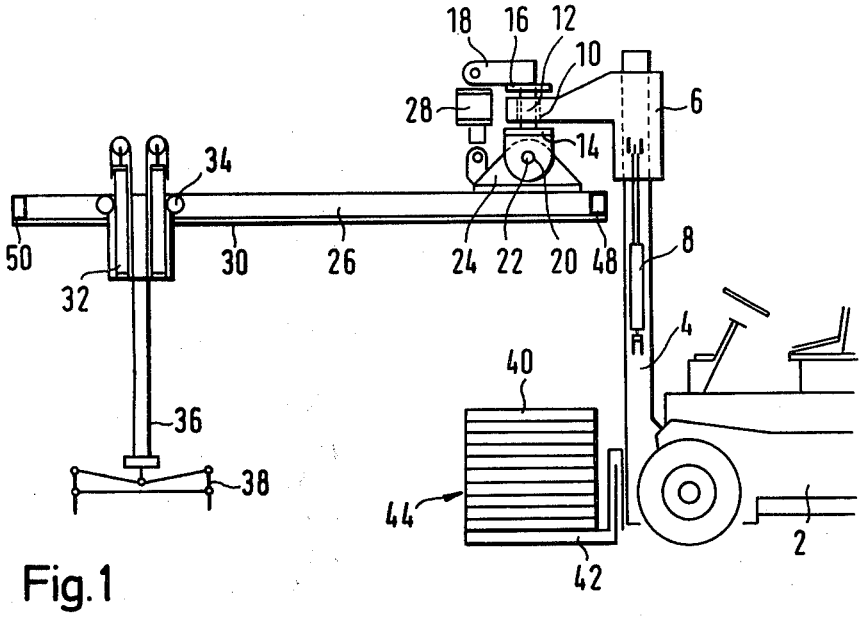
FIG. 1 is a side view of one form of apparatus embodying the invention.
Figure 2:
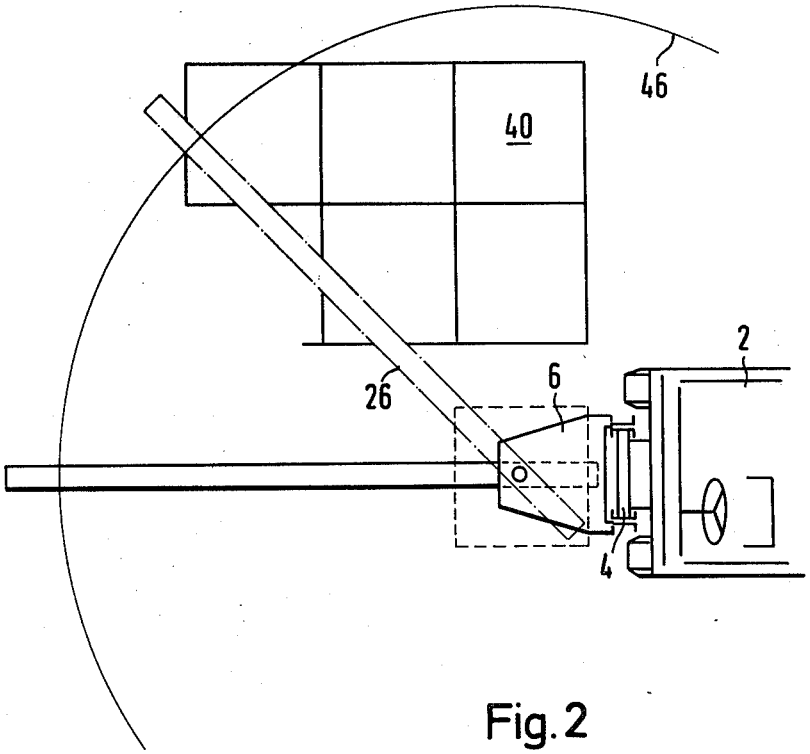
FIG. 2 shows the apparatus of FIG. 1 in plan.

In the apparatus of FIGS. 1 and 2, the front part of a fork-lift truck 2 is provided with a mast 4. A stack of paving elements 40, constituting a store 44, rests on the arms 42 of the fork lift truck.

An intermediate member 6 is mounted for up and down movement on the mast 4 of the fork-lift truck. The intermediate member 6 is guided on the fork-lift truck mast 4 by means of suitable roller or slide guides. Two hydraulic piston and cylinder assemblies 8 (of which one can be seen in FIG. 1) serve to raise and lower the intermediate member relative to the mast 4. One end of each of the hydraulic cylinders is secured to the mast 4, while a piston adapted to slide in the cylinder is connected to the intermediate member 6.

In the region of its free end the intermediate member 6 has a vertical bore 10. A rotatable pin 12 is received in the bore 10 and held against axial movement by a bottom disc 14 and an upper disc 16. Above the upper disc 16 an arm 18 projects from the pin 12 in the direction away from the mast 4. At its bottom end the pin 12 is enlarged to enable a horizontal bore 20 of adequate length to be provided.

In the horizontal bore 20 another pin 22 is mounted for rotation. A jib 26 is suspended with the aid of suitable reinforcing parts 24 from this additional pin 22. Between the free end of the arm 18 and the reinforcing part 24 a hydraulic piston-cylinder unit 28 is disposed by which the entire jib 26 can be inclined in a vertical plane passing through the pin 12, by turning about the additional pin 22 in the horizontal bore 20.

The jib 26 has a cross section having two flanges, for example a cross section in the form of an inverted T. A trolley 32 can move along the jib 26 by way of rollers 34 rolling along the flanges 30 of the jib 26. The trolley 32 has a winch (not shown) enabling ropes 36 of a pulley block to wind up and unwind. A gripper 38 for paving elements 40 hangs from the ropes 36. The gripper 38 may for example be a mechanical scissors gripper. It may be a gripper having hydraulically or pneumatically operated gripper jaws.

The end of the jib 26 nearer the mast 4 extends into the space between the axis of the swivel pin 12 and the mast 4, but is so short that the jib 26 can be swivelled over a wide range of about 270°.

The swivelling movement of the jib 26 and also the operation of the hydraulic cylinder 8 and 28 can preferably be controlled by remote control by the operator who remains near the placing site or near the position where the trolley 32 is situated at a given moment. The area which can be covered by the jib 26 is designated 46 (FIG. 2). This area 46 is at least so large that all the paving elements 40 of a delivered stack can be laid without moving the fork-lift truck 2.

The mast 4 of the fork-lift truck 2 carries conventional fork-lift truck arms 42. An entire stack of paving elements 40 rests on the fork-lift arms. The swivel axis formed by the vertical bore 10 ånd the vertical pin 12 lies exactly above the store 44 formed by the stack of paving elements; the projection of the center axis of the vertical pin 12 intersects the square paving elements at their center.

At the right-hand end of the jib 26 (FIG. 1) can be seen a welded-on stop 48 for the right hand rollers 34 (as seen in FIG. 1) of the trolley 32. The stop 48 is so disposed that when the trolley 32 is positioned against the stop the gripper 38 is situated exactly above the uppermost paving element 40 of the stack 44. At the outer end of the jib 26 (on the left as seen in FIG. 1) there is also a stop 50 which prevents the trolley 32 from rolling off the jib 26.

The intermediate member 6 is trapezoidal as seen in plan, the longer base of the trapezoid nearest the mast 4.

In the embodiment as shown in FIGS. 1 and 2 the swivel axis formed by the bore 10 and the pin 12 is situated at some distance from the mast 4 as seen in plan. The swivel axis may however also be disposed closer to the mast. In this case the center of the store 44 can no longer be situated directly under the swivel axis, but a certain horizontal distance between the swivel axis and the center of the paving elements 40 which faces the swivel axis, for example a distance in the range from 0 to 40 cm, is tolerable, since when the jib 26 is in a swivelled position in which it does not pass directly over the center of the store the gripper 38 can, because of the flexibility of the chains or ropes 36, simply be pulled laterally above a paving element 40 which is to be gripped.

The downward movement of the gripper 38 with the paving element 40 gripped by it, that is to say a movement relative to the jib 26 which is secured in respect of its height, and/or a movement together with the jib 26 relative to the mast 4, can also be made against the action of a spring, a counterweight, a pneumatic cylinder, or the like. When a paving element 40 has then been laid, an apparatus of this kind, can, because of the stored energy, lift the unloaded gripper 38 again without an external supply of energy, so that it can grip the next paving element 40. In this case, a suitable brake can conveniently be provided for the downward movement of the gripper 38.

Figure 3:
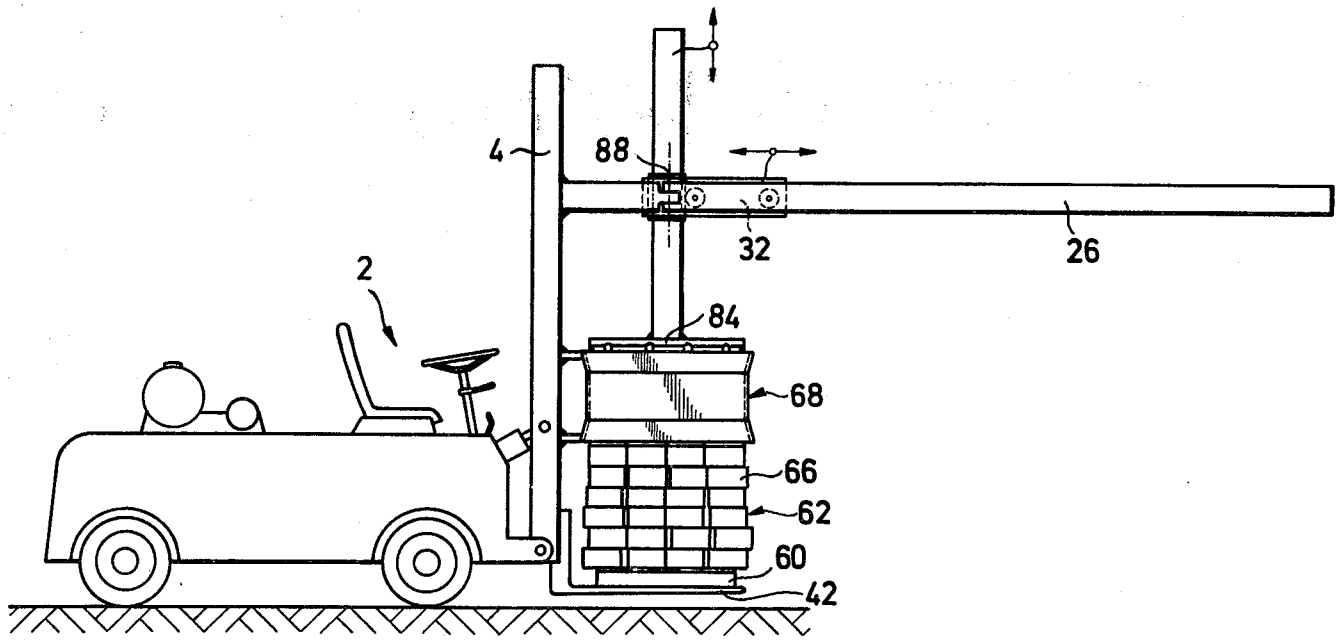
FIG. 3 is a side view of a second form of apparatus embodying the invention.

The fork-lift truck 2 shown in FIG. 3 is provided with a substantially or accurately vertical mast 4. Fork-lift truck arms 42 can be moved along the mast 4, usually by means of a chain drive (not shown in FIG. 3).

A pallet 60 is held by the fork-lift truck arms 42. On the pallet rests a stack 62 of stones or blocks 64 which form the store 44 and which are arranged in a number of layers 66 one above the other. Each layer 66 consists of a number of blocks 64 which is for example sufficient to cover an area of from 0.3 to 1.5 square metres.

Figure 4:
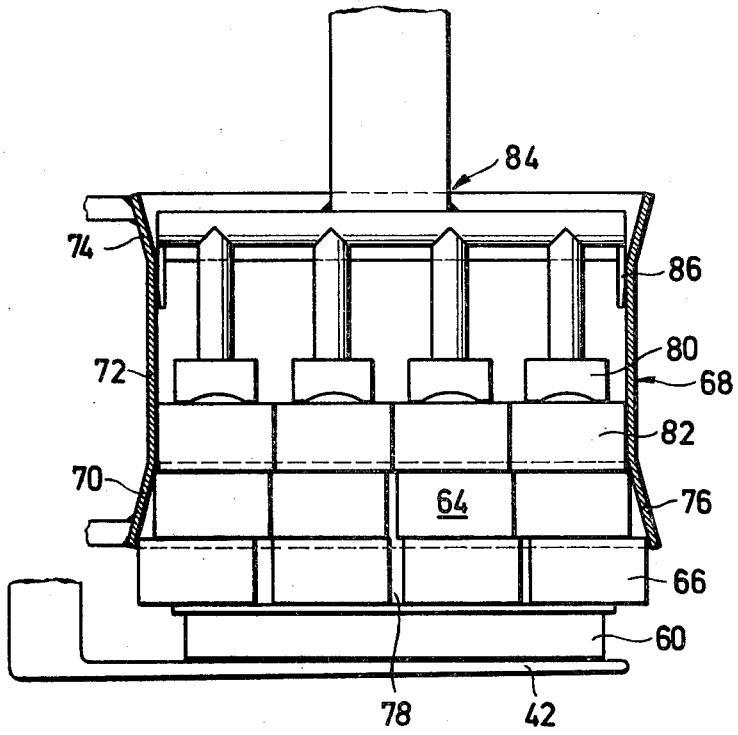
FIG. 4 is a side view, partly in section, of the aligning frame of the apparatus of FIG. 3, drawn to a larger scale.

An aligning frame 68 fastened to the mast 4 is best shown in FIG. 4. It has a bottom portion 70 which widens downwards in inverted funnel shape. This portion is followed in the upward direction by a central portion 72 having an internal cross-sectional area which is constant over its entire height. An upper portion 74 widens in the upward direction in funnel shape. In plan view all three portions 70, 72 and 74 are rectangular. The walls 76 of the bottom portion 70 form an angle of from 5° to 45° with the vertical. Instead of the flat walls 76 forming a constant angle to the vertical, as shown in the drawing, it is also possible for example to use walls which at the bottom end of the portion 70 form a comparatively small angle with the vertical, followed by a comparatively larger angle to the vertical, and then once again followed by a smaller angle to the vertical.

While the layers of blocks 66 in the stack 62 as delivered are only roughly pre-aligned, i.e., within a layer 66 there are unequal gaps 78 and in particular excessively large gaps 78 between the blocks 64, as the layers of blocks 66 are pushed upwards through the stationary aligning frame 68 they are aligned to form a group in which the blocks 64 are in determined positions relative to one another owing to the fact that the blocks 64 are pushed close together from all sides by the side walls 76 of the bottom portion 70 of the aligning frame 68. In the result only small gaps remain between the blocks 64. Since in particular large gaps 78 between the blocks 64 are made smaller or completely eliminated, only relatively small equal distances remain between the blocks 64 in the layer 66 which is situated in the central portion 72 of the aligning frame 68.

These small, uniform gaps are desirable on the one hand for the actual placing operation, that is to say the depositing of the blocks 64 on the ground, while experience has shown that during the actual laying of the blocks 64 there is a slight tendency for the gaps between the blocks to be enlarged, so that it need not be feared that the blocks 64 will be pushed too close to one another in the aligning frame 68. The accurate aligning of the blocks 64 in the aligning frame 68 is on the other hand also advantageous for the placing of suction nozzles 80 from above on the group 82 of aligned blocks 64, since each suction nozzle 80 is positioned with adequate accuracy above the center of a block 64.

The suction nozzles 80 are carried by a suction nozzle carrier 84. When a fresh uppermost layer 66 of the stack 62 of blocks has been completely aligned and is situated in the central portion 72, the suction nozzles are lowered from above onto the blocks 64 in that layer 66. The suction nozzle carrier 84 is for this purpose centered by means of centring attachments 84 which slide along the walls of the upper portion 74 and then along the walls of the central portion 72. When the suction nozzles 80 have been placed on the blocks 64 of the aligned group 82, suction is applied to them. The suction nozzle carrier 84 can then be lifted together with the entire group 82.

The suction nozzle carrier 84 is suspended on a trolley 32 adapted to run along a jib 26. The suction nozzle carrier 84 is adapted to be displaced vertically in relation to the trolley 32 and to be turned about a vertical axis in its guide by means of a drive (not shown). The suction nozzle carrier 84 is first lifted until the group 82 held by it is freed from the aligning frame 68, whereupon it is moved away from the mast 4 by means of the trolley 32. Above the desired placing site on the ground the suction nozzle carrier 84 is lowered until the group 82 lies on the ground or is a short distance above it. The suction applied by the suction nozzle 80 is then relaxed and the group 82 placed in position.

The substantially horizontal jib 26 is secured to the mast 4. It has a pivot 88 whose axis is vertical and which lies above the center of the aligning frame 68. By means of the pivot 88 the free outer portion of the jib 26 can be swivelled in a circle, so that from one standing position of the fork-lift truck 2 an area of the ground in the form of a sector of a circle can be mechanically paved with blocks 64. Since the pivot 88 lies above the center of the aligning frame 68, whatever the angular alignment of the jib 26 at the moment in question, when the trolley 32 returns it is automatically in the position from which the suction nozzle carrier 84 can be lowered into the aligning frame 68. If this advantage is not deemed that relevant, the pivot 88 can be at a distance from the center of the alignment frame, as seen in plan view, for example it may coincide with the axis of the mast 4.

The aligning frame 68 is fastened to the mast 4. In the embodiment illustrated the stack 62 of blocks is lifted vertically relative to the stationary aligning frame 68. The aligned group 82 is also lifted vertically by means of the suction nozzle carrier 84. The same applies to the lowering movement of the suction nozzle carrier 84 for the purpose of depositing the group 82 on the ground which is to be paved.

By suitably adjusting the height of the pallet 60 and/or suitably shaping the fork-lift truck arms 42 and/or by means of an intermediate spacer layer between the lowermost layer of blocks 66 and the pallet 60, it is ensured that the fork-lift truck arms 42 can raise the stack of blocks 62 to such a height that the lowermost layer of blocks 66 is also aligned in the central portion 72 of the aligning frame 68.

For certain applications it may be advantageous for the entire aligning frame 68 to be lightly shaken in order to increase the aligning effect. Instead of an aligning frame having an upwardly tapering bottom portion 70 it is also possible to provide displacing bars which are adapted to be displaced mechanically, hydraulically, pneumatically, or electrically in the horizontal direction and which push together the blocks 64 in each uppermost layer 66 after a new layer 66 has been brought between the displacing bars through the raising of the fork-lift truck arms 42. Two pairs of displacing bars of this kind are conveniently provided.

Before being pushed into the aligning frame 68 the blocks 64 may be already in the form of the desired laying pattern, for example a line bond pattern, parquet bond pattern, herring-bone bond pattern and the like, and in the aligning frame they can then be aligned to form an aligned bonding group. There are laying patterns for blocks 64 in which it may be advantageous to provide recesses in the substantially rectangular contour of each layer of blocks 66. As an example mention may be made of the herring-bone bond pattern in which at those places in the layer of blocks 66 where a substantially rectangular contour of the layer of blocks 66 would intersect individual blocks 64 it is advantageous for these blocks 64 to be omitted so as to form a recess in the edge of the layer of blocks 66. By means of appropriate vertical guide rails on the inside of the walls of the aligning frame 68, such layers of blocks 66 can be aligned in the aligning frame 68 with recesses on their periphery to form a bonding group of aligned blocks 64.

If inter-engaging blocks having projections and recesses on their periphery are to be aligned, the aligning frame 68 or the displacing bars may have internally a complementary profile. The blocks 64 of a layer of blocks 66 may be of different sizes from one another.

In all the embodiments described above the load carrier 38 or 84 is rotatable about a vertical axis, for example by turning the ropes 36, in order to enable the paving elements 40 or 64 to be laid correctly.

What we claim and desire to secure by Letters Patent is:

1. A vehicle for placing paving elements into desired placing positions on the subsoil, comprising:

(a) support means mounted on the vehicle for supporting a store of paving elements;

(b) a generally vertical mast mounted on the vehicle;

(c) a jib;

(d) swivel means for mounting said jib, at a portion thereof, to said mast to provide for an angular displaceability of said jib about a vertical axis over a swivelling range; said jib extending away from said mast and being located higher than said support means; said vertical axis passing at least in the proximity of said support means whereby said portion of said jib is situated substantially vertically above said support means irrespective of the swivelled position of said jib;

(e) a trolley mounted on said jib for travel therealong;

(f) a load carrier mounted on said trolley; and (g) elevator means operatively related to said trolley for raising and lowering said load carrier for picking up paving elements from said support means when said trolley is in the zone of said portion of said jib and for placing the paving elements on the subsoil into desired placing positions determined by the selected swivelled position of said jib and the selected location of said trolley on said jib.

2. A vehicle as defined in claim 1, further comprising stop means on said jib located at said portion thereof for being abutted by said trolley when said trolley occupies said portion of said jib, whereby said stop means positions said trolley above said support means.

3. A vehicle as defined in claim 1, wherein said support means comprises fork-lift truck-type lifter forks.

4. A vehicle as defined in claim 1, further comprising tilting means connecting said jib to said mast; said tilting means providing for a tilting motion of said jib about a horizontal axis.

5. A vehicle as defined in claim 1, further comprising an aligning device for aligning a plurality of roughly aligned paving elements on said support means; and further wherein said load carrier comprises suction means including a plurality of suction apertures for holding the paving elements in a position as aligned by said aligning device.

6. A vehicle as defined in claim 5, said aligning device comprising an aligning frame having converging walls and a displacement device for displacing said plurality of roughly aligned paving elements and said aligning frame relative to each other so that upon such displacement said plurality of paving elements are shifted towards each other by the convergence of said converging walls.

7. A vehicle as defined in claim 6, wherein said displacement device comprises lifter means for lifting said store of paving elements relative to said aligning frame whereby consecutive superposed layers of said paving elements can be sequentially aligned upon sequential lifting movements of said lifter means relative to said aligning frame.

8. A vehicle as defined in claim 7, wherein said lifter means comprises fork-lift truck-type lifter forks.

* * * * *